United States Patent [19]

Andersen

[11] 4,432,795

[45] Feb. 21, 1984

[54] SINTERED POWDERED TITANIUM ALLOY AND METHOD OF PRODUCING SAME

[75] Inventor: Phillip J. Andersen, Cleveland Heights, Ohio

[73] Assignee: Imperial Clevite Inc., Rolling Meadows, Ill.

[21] Appl. No.: 349,432

[22] Filed: Feb. 16, 1982

Related U.S. Application Data

[63] Continuation of Ser. No. 97,508, Nov. 26, 1979, abandoned.

[51] Int. Cl.[3] ..... C22C 14/00; C22C 1/04; B22F 1/00

[52] U.S. Cl. ..... 75/245; 419/23; 419/30; 419/32; 419/33; 419/38; 419/46

[58] Field of Search ..... 75/200, 211, 214, 245, 75/0.5 R; 419/32, 38, 46, 23, 30, 33

[56] References Cited

U.S. PATENT DOCUMENTS

| | | | |
|---|---|---|---|
| 3,084,042 | 4/1963 | Wartel et al. | 75/221 |
| 3,158,472 | 11/1964 | Von Bogdandy et al. | 75/211 X |
| 3,276,867 | 10/1966 | Brite et al. | 75/201 X |
| 3,832,156 | 8/1974 | Wilson et al. | 75/213 X |
| 3,865,575 | 2/1975 | Volin et al. | 75/0.5 R |
| 3,950,166 | 4/1976 | Obara et al. | 419/23 |
| 3,976,482 | 8/1976 | Larson | 419/32 X |

OTHER PUBLICATIONS

Hirschhorn, J. S., *Introduction to Powder Metallurgy,* Amer. Powder Metal Inst., N.Y., N.Y., 1969, pp. 2–4.

Jones, W. D., *Fundamental Principles of Powder Met.,* Edward Arnold Publsrs. Ltd., London, 1960, pp. 266–270.

Hausner, H. H., *Handbook of Powder Metallurgy,* Chemical Publishg. Co. Inc., N.Y., N.Y., 1973, pp. 1–4, 14.

Kirk-Othmer, *Encyclopedia of Chemical Technology,* 2nd Ed., 1968, vol. 16, pp. 405–406, 410–418.

*Primary Examiner*—Brooks H. Hunt
*Assistant Examiner*—Matthew A. Thexton
*Attorney, Agent, or Firm*—Russell E. Baumann

[57] ABSTRACT

A sintered powdered titanium alloy article is provided which has a density approaching theoretical and which is characterized by having physical properties similar to those of a wrought titanium alloy article having the same chemical composition. This unique article is produced by a novel process which comprises (a) providing milled alloy forming particles having a median particle size by weight of 20 microns or less, with the alloy forming particles being alloyable with titanium; (b) mixing the as milled alloy forming particles with titanium base particles having a median particle size by weight of greater than 40 microns so as to form a particle mixture capable of being sintered to near theoretical density which mixture contains a minor amount of alloy forming particles; (c) compacting the mixture of as milled alloy forming particles and titanium base particles into an article of the desired configuration having a green density sufficient to render the so-produced article capable of being sintered to near theoretical density; and (d) sintering the article at a temperature below that at which any liquid phase is formed in the article to produce a sintered article which has a density approaching that of theoretical.

7 Claims, No Drawings

SINTERED POWDERED TITANIUM ALLOY AND METHOD OF PRODUCING SAME

This application is a continuation, of application Ser. No. 06/097,508, filed Nov. 26, 1979 abandoned.

BACKGROUND OF THE INVENTION

This invention relates to the art of powder metallurgy and more particularly to the method of making a high density powdered metal titanium alloy article and to the products of such method.

For many years, powder metallurgists have been attempting to produce structural powder metal alloys, such as titanium base alloys, which have physical properties approaching or equaling those of cast or wrought alloys of similar compositions. To accomplish this, various techniques have been developed to reduce the porosity of the powder alloys to a minimum to thereby increase the sintered density of the concerned article to near theoretical. These high densities result in strengths nearly equal to those of cast or wrought materials and at the same time reduce to a minimum the notch sensitivity of the resultant article due to retained porosity.

For example, it has been known in the prior art to produce powdered metal products with densities similar to those of wrought products by the use of secondary processing techniques such as hot or cold working and/or hot isostatic pressing. These secondary operations, however, greatly add to the cost of the finished product and are to be avoided, if possible.

In addition, it is known in the art to produce relatively high density powdered products by sintering them at a temperature which introduces a liquid phase. Much of the recent work in this area has involved introducing a transient liquid phase. However, the use of a liquid phase has the drawback of introducing many reliability problems, especially with regard to brittleness. Additionally, the control of the exact sintering temperature becomes very important and in commercial practice is very difficult to maintain.

Also, it is known in the art to produce relatively high density powdered products by forming them entirely out of a very fine grain powder. This technique, as evidenced by U.S. Pat. No. 3,744,993, requires extra processing steps to produce the fine powder and to assure that all the powder is of the proper size. However, this technique is not without significant problems. In this regard, perhaps the most significant problem associated with the technique of using all fine powder is that the smaller the particle size of the powder, the greater is its tendency to be pyrophoric. Obviously, it is desirable to avoid or minimize problems associated with the use of such pyrophoric materials.

Accordingly, it is the principal object of the present invention to provide a method of producing a powdered titanium alloy article by powder metallurgy techniques which article exhibits physical properties similar to those of an article formed from wrought titanium alloy of the same composition.

It is another object of the present invention to provide an improved method of producing high density titanium alloys from powders by means of a single pressing and sintering operation.

It is still another object of the present invention to provide an improved powdered metal high density article.

A further object of the invention is to provide a powder metallurgy technique for producing a sintered titanium alloy having a density near theoretical while reducing the amount of fine particles required to produce the same to thereby minimize the problems typically associated with the handling of pyrophoric materials.

Other objects of the invention will become apparent from a reading of the following specification and claims.

SUMMARY OF THE INVENTION

In one aspect, the present invention concerns a process for producing a sintered powdered titanium alloy article having a density near theoretical while minimizing the amount of fine particles required to produce satisfactory densification which method comprises:

(a) providing alloy forming particles having a median particle size by weight of 20 microns or less, with the alloy forming particles being alloyable with titanium;

(b) mixing the alloy forming particles with titanium base particles having a median particle size by weight of greater than 40 microns so as to form a particle mixture capable of being sintered to near theoretical density which mixture contains a minor amount of alloy forming particles;

(c) compacting the mixture of alloy forming particles and titanium particles into an article of the desired configuration having a green density sufficient to render the so-formed article capable of being sintered to near theoretical density; and (d) sintering the article at a temperature below that at which any liquid phase is formed in said article.

In another aspect, the present invention relates to a sintered powdered titanium alloy article having a density approaching theoretical which is characterized by having physical properties similar to those of a wrought titanium alloy article having the same chemical composition which sintered article is produced by a process which comprises:

(a) providing alloy forming particles having a median particle size by weight of 20 microns or less, with the alloy forming particles being alloyable with titanium;

(b) mixing the alloy forming particles with titanium base particles having a median particle size by weight of greater than 40 microns so as to form a particle mixture capable of being sintered to near theoretical density which mixture contains a minor amount of alloy forming particles;

(c) compacting the mixture of alloy forming particles and titanium base particles into an article of the desired configuration having a green density sufficient to render the so-formed article capable of being sintered to near theoretical density; and (d) sintering the article at a temperature below that at which any liquid phase is formed in said article.

BRIEF DESCRIPTION OF THE PREFERRED PRACTICE OF THE INVENTION

The present invention concerns a novel sintered powder metal titanium alloy article and the method of producing the same.

In practice, the article of the invention is produced from at least two special types of powdered metal particles, specifically alloy forming particles and titanium base particles, which particles, in turn, are mixed together, compacted and then sintered in a manner such that no liquid phase is formed during the sintering procedure. In this regard, as used herein the term "alloy forming particles" includes one or more elemental metal particles which combine to form an alloy, particles of a pre-alloyed material and mixtures of such particles.

The chemical composition of the alloy forming particles is not critical, except that it must be chemically compatible with titanium, that is it must be alloyable with titanium. Additionally, it is thought that the relative diffusion rates of the alloy forming particles and the titanium base metal particles must be of a relatively comparable magnitude. By way of example, and not for the purpose of limiting the scope of the invention, typical materials used to form such alloy forming particles are aluminum-vanadium alloys; aluminum-vanadium-tin alloys; and aluminum-tin-molybdenum-zirconium alloys.

The preferred alloy forming particles are produced from an alloy of aluminum and vanadium. While the ratio of aluminum to vanadium is not critical, to date excellent results have been obtained using a 60 aluminum/40 vanadium alloy.

To obtain the benefits of the present invention it is essential that the median particle size of the alloy forming particles be 20 microns or less. This can be accomplished via a number of well known techniques. However, it has been found that such particles can be readily obtained by attriting alloy forming particles in a commercially available apparatus, such as a Szegvari 1-S attritor, manufactured by Union Process Inc., Akron, Ohio. In practice, it has been found desirable to utilize alloy forming particles having a median particle size ranging from about 0.5 to 20.0 microns, with the best results obtained when the median particle size range is from about 2.0 to about 15.0 microns.

The titanium base particles used in the practice of the present invention can be produced by a myrid of well known techniques and as such techniques do not form a part of the present invention they will not be described herein. However, it is essential to the practice of the present invention that the titanium base material utilized have a median particle size by weight of greater than 40 microns, with good results being realized when the median particle size by weight of the titanium base particles range from about 40 to about 177 microns, and exceptional results being achieved when the particle size range by weight is from about 44 to 105 microns.

While it is preferred that the titanium base particles be chemically pure titanium, as used herein the term "titanium base" particles is intended to include titanium and alloys of the titanium wherein the alloying element or elements are present in minor or trace amounts. Generally speaking, the titanium base material should be commercially pure and contain in excess of about 99 weight percent titanium, with the criterion being that the resultant material significantly evidence the chemical and physical properties of titanium.

The alloy forming particles and the titanium base particles can be mixed together in any conventional manner, for example by simple mechanical blending, with the alloy forming particles being present in an amount sufficient to cause satisfactory densification upon sintering. However, it is essential that the major component of the alloy forming particle-titanium base particle mixture be titanium base particles. In practice, it is preferred that the titanium base particles be present in the resultant mixture in an amount ranging from about 70 weight percent to about 95 weight percent (remainder being alloy forming particles) with exceptionally good results being achieved when the amount of titanium base particles ranges from 75 to 92 weight percent (remainder being alloy forming particles).

In mixing the alloy forming particles and titanium base particles it is essential that the weight ratio of particles be selected in such a manner that the resultant powder is capable of being formed and the sintered to near theoretical density without the formation of any liquid phase. That is, depending on the specific composition of the alloy forming particles, various amounts or ratios of alloy forming particles to titanium base particles can be utilized. This can be determined emperically with the criterion being that (a) the alloy forming particles have a median particle size by weight of 20 microns or less and (b) that the formed article be compactible to a degree sufficient to yield upon sintering an article having a density which is near theoretical.

In forming the article of the invention no special procedures are required, except that the article must be compacted to a degree sufficient to render the resultant article capable of being sintered to near theoretical density. Both conventional and isostatic molding techniques have been employed successfully. In practice, it has been found satisfactory to form or compact the green article to a density of about 65 to about 90 percent of theoretical with excellent results being achieved when the green density ranges from about 80 to about 90 percent of theoretical.

Once the desired article is formed it can be sintered in a conventional manner. The exact sintering temperature employed will vary somewhat depending on the composition and amount of the various components which make up the article, with the only requirement being that no liquid phase be formed during the sintering procedure. For an article comprising 90 weight percent titanium and 10 weight percent 60 aluminum/40 vanadium, it has been found desirable to sinter at a temperature ranging from about 2100° to about 2350° F. for a period ranging from about 1 to about 8 hours.

Typical physical properties of articles produced according to the present invention are: 135 ksi U.T.S., 125 ksi Y.S., 15% elongation, and 27% R.A. for the 90 titanium-6 aluminum-4 vanadium alloy (the product of Example II).

By way of contrast, the minimum properties specified for a forged wrought article, as set forth in ASTM B348, having a similar chemical composition are as follows: 130 ksi U.T.S., 120 ksi Y.S., 10% elongation, and 25% R.A.

The subject invention will now be described with reference to the following examples which are set forth for the purpose of illustrating the present invention and not for the purpose of limiting the same.

EXAMPLE I

Consistent with prior art practice, a 3.7" by 0.58" by 0.60" sintered 90 titanium-6 aluminum-4 vanadium alloy article was obtained as follows.

Approximately 10 weight percent of a nominal 60 Al/40 V alloy powder, −80 mesh, was blended with 90 weight percent −100 mesh Ti. This blend was then compacted at 50 tsi in a rigid mold to a green density of about 88–90% of theoretical, and the so-formed article was then vacuum sintered 4 hours at 2300° F.±25 to a final density of about 94.5–96.5% of theoretical. This article exhibited the following physical properties: 115 ksi U.T.S., 108 ksi Y.S., 6% elongation, and 9% R.A.

EXAMPLE II

Two pounds of 60 Al/40 V were put into a Szegvari S-1 attritor along with about 40 pounds of ⅛" steel balls and about ½ gallon of Freon. This Al/V alloy was attrited for 30 minutes, removed from the attritor and dried. The resultant median particle size, as determined by Coulter counter, was about 3.0 microns. This powder was added to −100 mesh Ti and processed and sintered as in Example I. The resultant sintered density was 99.3–99.8% of theoretical.

EXAMPLE III

The procedure of Example II was repeated, except attrition time was 7 minutes with resulting median particle size being approximately 10 microns. The resultant sintered density was 99.0% of theoretical.

EXAMPLE IV

The procedure of Example II was repeated, except 8 pounds of powder were attrited to a resultant median particle size of about 6.5 microns. The resultant sintered density was 99.5% of theoretical.

EXAMPLE V

The procedure of Example II was repeated, except distilled $H_2O$ was used instead of Freon in the attritor. The resultant sintered density was 99.5–99.8% of theoretical.

EXAMPLE VI

The procedure of Example II was repeated, except sintering was at 2200° F.±30° F. The resultant sintered density was 99.3–99.4% of theoretical.

EXAMPLE VII

The procedure of Example II was repeated, except the compaction pressure was about 30 tsi. The green density was 83–84% of theoretical. The sintered density was 99.0–99.1% of theoretical.

EXAMPLE VIII

The procedure of Example II was repeated, except Mullite balls were used, with the resultant median particle size being less than 10 microns. The sintered density was 99.5% of theoretical.

EXAMPLE IX

The procedure of Example II was repeated, except −60+200 mesh Ti was used. The resultant sintered density was 99.4% of theoretical.

EXAMPLE X

The procedure of Example I was repeated, except the powder was compacted at 60,000 psi in a flexible mold in an isostatic press to form a 3" diameter billet with a green density of about 86–88% of theoretical. After sintering, the billet had a density of 88–92% of theoretical.

EXAMPLE XI

The procedure of Example X was repeated, except Al/V powder prepared as in Example II was used. The resultant sintered density of the 3" billet was 99.8% of theoretical.

EXAMPLE XII

A mixture of −325 mesh 50 Al/50 V alloy, −325 mesh Sn, and −100 mesh Ti was formed to give an 86 Ti-6 Al-6 V-2 Sn alloy powder. This mixture was processed as in Example I with the resultant sintered density being about 96.6% of theoretical. The physical properties of this article were: 131 ksi U.T.S., 113 ksi Y.S., 6.5% elongation, and 10% R.A.

EXAMPLE XIII

A 42 Al-42 V-16 Sn alloy was attrited as described in Example II. Subsequently, this attrited alloy was mixed with −100 mesh Ti to give an 86 Ti-6 Al-6 V-2 Sn alloy powder and processed as described in Example I. The resultant sintered density was approximately 99.9% of theoretical. The physical properties of this article were: 152 ksi U.T.S., 138 ksi Y.S., 12% elongation and 16% R.A.

The benefits of the present invention are apparent from the foregoing illustrative examples. For example, it is to be noted that a conventionally produced powdered metal 90 Ti-6 Al-4 V alloy had a density of 94.5–96.5% of theoretical (Example I) whereas an essentially identical 90 Ti-6 Al-4 V alloy produced by the technique of the present invention had a density of 99.3–99.8% of theoretical (Example II). This difference in percent of theoretical density is exceptionally significant because the article having a density of 99.3–99.8% of theoretical exhibits chemical and physical properties similar to a wrought alloy of the same composition whereas the article having a density which was 94.5–96.5% of theoretical does not.

It should be noted that the particle sizes set forth herein was determined by use of a Coulter counter and that the particle size given is the median particle size by weight as determined by the use of this apparatus.

Articles produced according to the present invention are characterized by the fact that they can contain relatively high amounts of oxygen (up to about 0.30–0.35 weight percent) and still exhibit excellent ductility (an elongation of about 12–13 percent). This is in contradistinction to cast or wrought articles of similar chemical composition (having an oxygen content ranging from about 0.30 to about 0.35 percent) which exhibit limited ductility (an elongation of about 5–6 percent). That is, articles produced according to the present invention get strength from the presence of relatively high amounts of oxygen, but this does not destroy their ductility. Such articles are obviously superior to those produced by prior art techniques.

In fhe practice of the invention, it is preferred to adjust the process parameters such that the resultant sintered density of the concerned powdered metal article is at least 97% of theoretical.

While there have been described what are at present considered to be the preferred embodiments of this invention, it will be apparent to those skilled in the art that various changes and modifications may be made therein without departing from the invention, and it is, therefore, intended in the appended claims to cover all such changes and modifications as fall within the true spirit and scope of the invention.

What is claimed is:

1. A process for producing a sintered powdered titanium alloy article having a density near theoretical while minimizing the amount of fine particles required to obtain satisfactory densification which comprises:

(a) providing alloy-forming particles which have been milled to an average particle size ranging from about 0.5 to 20.0 microns, said particles being capable of alloying with titanium;

(b) mixing said alloy-forming particles in the as-milled condition with titanium-base particles having an average particle size ranging from about 40 to 177 microns so as to form a powder mixture containing about 70–95 weight percent of said titanium-base particles and the balance substantially said alloy-forming particles;

(c) compacting said powder mixture into an article of the desired configuration having a green density ranging from about 80 to 90 percent of theoretical density sufficient to render said article capable of being sintered to near theoretical density; and (d) sintering said article at an elevated temperature below that at which any liquid phase is formed in said article, whereby said article has physical properties similar to a wrought produced article.

2. The process of claim 1, wherein said alloy-forming particles are pre-alloyed particles.

3. The process of claim 2, wherein said pre-alloyed particles are comprised of an alloy of aluminum and vanadium.

4. The process of claim 3, wherein the composition of said pre-alloyed particles comprises about 60 weight percent aluminum and about 40 weight percent vanadium.

5. The process of claim 1, wherein said titanium-base particles contain in excess of about 99 weight percent titanium.

6. The process of claim 1, wherein the alloy-forming particles are provided with said average particle size of about 0.5 to 20 microns by milling a charge of said alloy-forming particles in an attritor mill containing grinding balls and a liquid.

7. The process of claim 6, wherein said liquid is Freon.

* * * * *